US005247968A

United States Patent [19]

Hübner et al.

[11] Patent Number: 5,247,968

[45] Date of Patent: Sep. 28, 1993

[54] PROJECTILE LOOM HAVING A COMPOSITE MATERIAL MULTIPLE WEFT DEVICE

[75] Inventors: Oskar Hübner, Radolfzell; Rudolf Stauner, Konstanz, both of Fed. Rep. of Germany

[73] Assignee: Sulzer Brothers Limited, Winterthur, Switzerland

[21] Appl. No.: 939,207

[22] Filed: Sep. 1, 1992

[30] Foreign Application Priority Data

Sep. 19, 1991 [CH] Switzerland ..... 02783/91

[51] Int. Cl.[5] ..... D03D 47/24; D03D 47/38

[52] U.S. Cl. ..... 139/438; 139/196.2; 139/453

[58] Field of Search ..... 139/438, 439, 453, 196.2

[56] References Cited

U.S. PATENT DOCUMENTS 4,846,232 7/1989 Pfarrwaller ..... 139/439
5,033,514 7/1991 Just et al. ..... 139/145

FOREIGN PATENT DOCUMENTS 0190798 8/1986 European Pat. Off. .
0340162 11/1989 European Pat. Off. .
0350447 1/1990 European Pat. Off. .
942979 5/1956 Fed. Rep. of Germany .
1710356 4/1972 Fed. Rep. of Germany .
2523603 9/1983 France .

*Primary Examiner*—Andrew M. Falik
*Attorney, Agent, or Firm*—Townsend and Townsend Khourie and Crew

[57] ABSTRACT

A projectile loom is distinguished by a combination wherein a weft yarn changer (1) has a low-weight body (11) and low-weight yarn transfer elements (2) and the multiple weft device is driven directly by a highly dynamic servo motor (3). The loom can be operated at speeds above 350 rpm. The changer body (11) is made, for example, of aluminum and the slide bar (2a) of the yarn transfer element (2) is made of a mixture of plastics and fibers.

6 Claims, 2 Drawing Sheets

Fig.1a
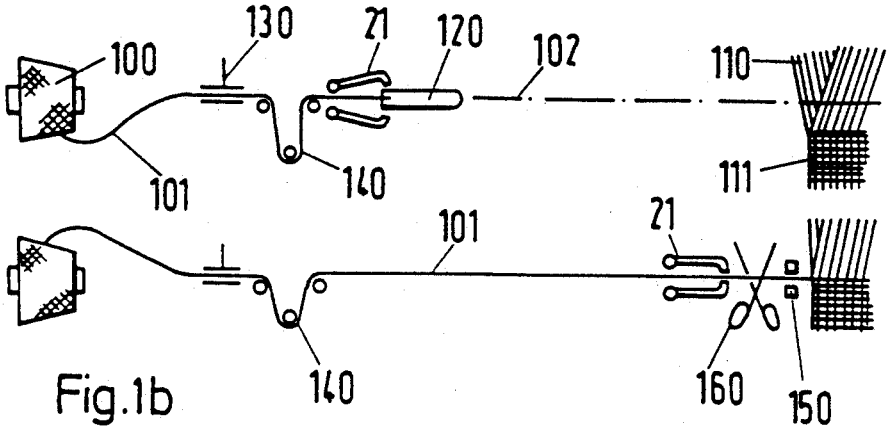
Fig.1b
Fig.2
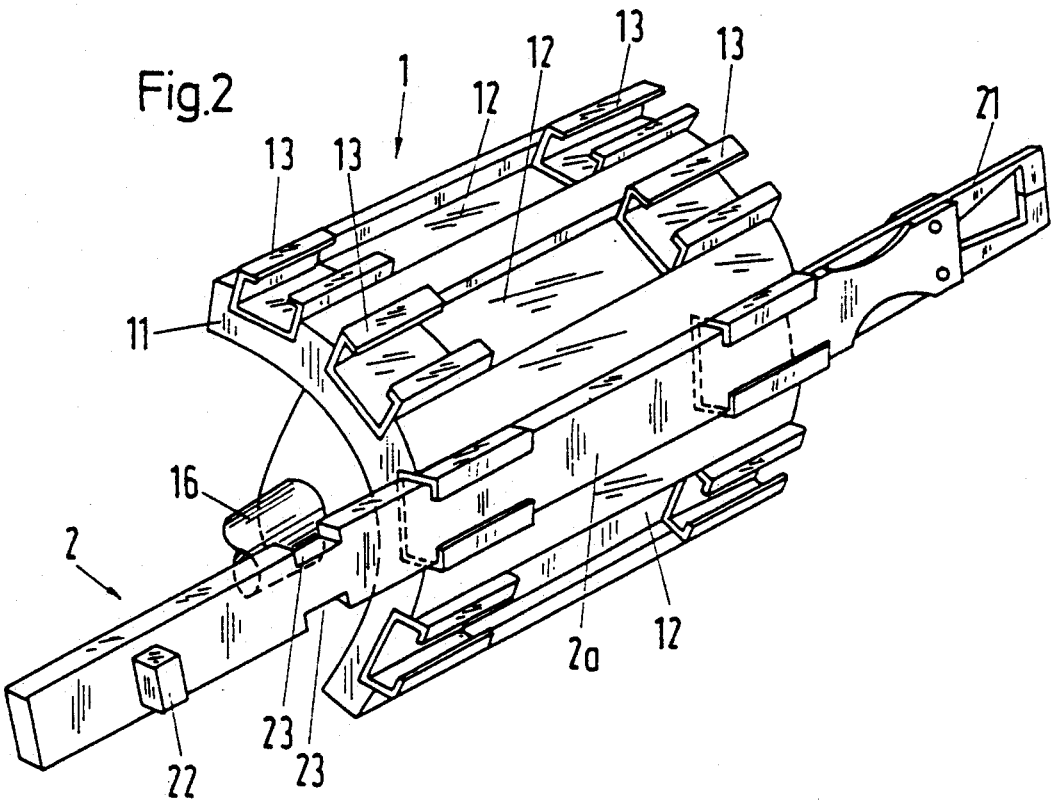

PROJECTILE LOOM HAVING A COMPOSITE MATERIAL MULTIPLE WEFT DEVICE

BACKGROUND OF THE INVENTION

The invention relates to a projectile loom having a multiweft device, more particularly to the drive and weft changer of such device.

Through the agency of a yarn transfer element of the weft changer, such element being known conventionally as a giver or retractor, the weft yarn tip is pulled near the shears before the shed after picking and drawn back by means of a yarn tensioner; also, by means of the same yarn transfer element or, in the event of a yarn change, the different yarn transfer element the yarn for the next pick is transferred to the projectile by means of clamp openers. The changer body has guideways or slideways for the yarn transfer elements. When the same are in the drawn-back position the changer body can be pivoted through one or more steps to make a required change of color or weft yarn.

In the course of the development of projectile looms, during which productivity has increased continuously inter alia because of increasing loom speeds, no major improvements were made to the weft changers of multicolor looms for a long time (see e.g. DE-PS 942 979=T.175). In the end, however, the yarn changer proved to be a speed-determining component. More particularly in the case of cloths having, for example, four weft colors such that maximum pivoting movements of the changer were necessary because of the color sequence, loom speeds had to be reduced considerably as compared with the speeds of two-color or weft mixer looms. This led to the patterns of some fabrics being so modified that color changing involving extreme changing steps was abandoned in order to cut out extreme changer strokes and thus enable the looms to run faster. Of course the restricted choice of colors was not a satisfactory solution of the problem. Endeavours to solve the problem led to a reduction of the moment of inertia of the changer and of the mass of the yarn transfer elements to help reduce operating times.

The weft changer of known projectile looms is driven by the main shaft or the shedding motion by way of a control unit (see e.g. DE-PS 1 710 356=T.328). This kind of drive is elaborate and so there has for many years been a desire for a direct drive by means of a highly dynamic servo motor enabling the changer to be controlled directly. It is known to control warp tension by means of highly dynamic servo motors (EP-PA 0 350 447=T.757). A servo motor of this kind has, for example, electronic commutation and is brushless and has a low-weight rotor which has a low moment of inertia and which has high field strength permanent magnets. It is the object of the invention to provide a projectile loom with a multiweft device, more particularly for at least four colors, the weft changer being actuatable at a loom speed of more than 350 revolutions per minute by a direct drive—i.e., by a final control element acting directly on the changer.

The torques and outputs of conventional stepping or servo motors are too low to be of use instead of conventional weft changer drives. However, the development of highly dynamic servo motors has already advanced to such an extent that the problem addressed by the invention as hereinbefore set out can be solved.

As a result of the efforts to reduce the changeover times of weft yarn changers together with the concomitantly developed yarn transfer elements and changer bodies, highly dynamic servo motors such as are now available can be used for the direct drive of multiple weft devices in combination with the low-weight components of the weft yarn changer.

SUMMARY OF THE INVENTION

The projectile loom according to the invention is distinguished by a combination wherein a weft yarn changer has a low-weight body and low-weight yarn transfer elements and the multiple weft device is driven directly by a highly dynamic servo motor. The loom is adapted to operate at speeds above 350 rpm. The changer body is made, for example, of aluminum and the slide bar of the yarn transfer element is made of a mixture of plastics and carbon fibers.

BRIEF DESCRIPTION OF THE DRAWINGS

FIG. 1*a* is a diagrammatic illustration of the components of a single-color projectile loom which are important for picking, the components being shown at the instant of yarn transfer to the projectile;

FIG. 1*b* is a similar illustration to FIG. 1*a* during the drawing-back of the weft yarn tip;

FIG. 2 is a perspective view of a changer body of use in a four-colour loom according to the invention.

DESCRIPTION OF THE PREFERRED EMBODIMENTS

Figure 3:
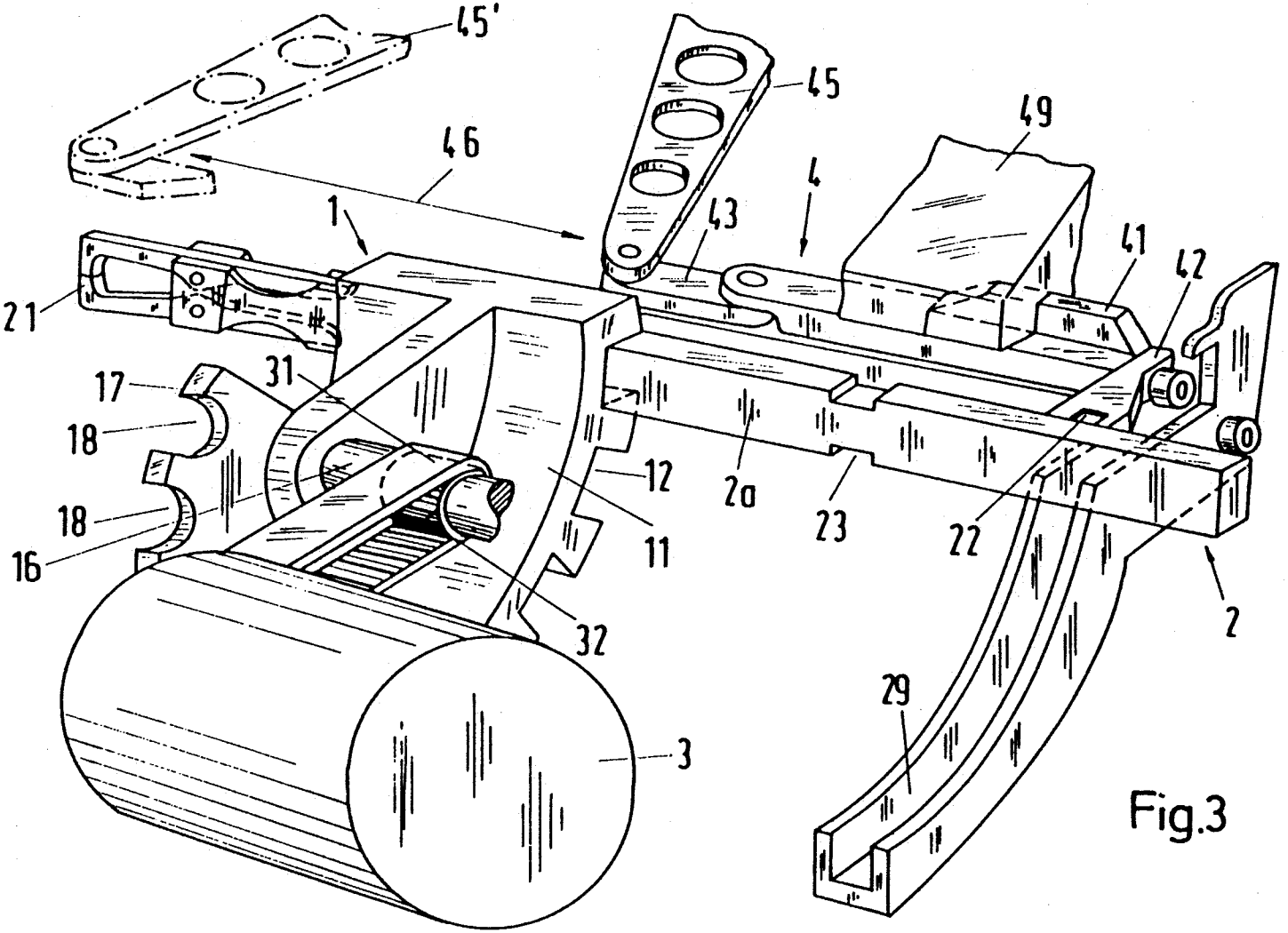
FIG. 3 is a perspective view of the components of the multiweft device which form the combination distinguishing the invention.

FIGS. 1*a* and 1*b* show in diagrammatic form a weft package 100, a weft yarn 101, a yarn brake 130, a yarn tensioner 140, a yarn clamp 21 of a yarn transfer element (not shown), a projectile 120 which after shoot-off moves on a flight path 102, a shed 110 with cloth 111, an edge yarn clamp 150 and shears 160. In FIG. 1*a* the tip of the weft yarn 101 is being transferred to the projectile 120 by the clamp 21 opening and the projectile clamp closing. In FIG. 1*b* the weft yarn 101 is being engaged by the edge yarn clamp 150 and the clamp 21, which latter has moved towards the shed, and is being severed by the shears 160, whereafter the weft yarn 101 can be drawn back by the weft transfer element as a result of co-operation between the tensioner 140 and the brake 130, the latter being "on".

FIG. 2 shows a weft yarn changer 1 in which a yarn transfer element 2 has been introduced. A changer body 11 has channels 12 receiving guide elements 13 for guiding the slide bar 2*a* and is pivotable around a shaft 16. The body 11 is made of a lightweight material, preferably aluminium or a plastic. The guide elements 13 in which the bars 2*a* reciprocate are made of an abrasion-resistant substance, preferably steel. The guide elements 13 can be secured in the channels 12, for example, by sticking. If the channels 12 are provided with an abrasion-resistant coating, they can themselves perform the guide function without additional guide elements 13.

The yarn transfer element 2 having the clamp 21 has a lateral projection 22 adapted to transmit the reciprocation from a drive which is partly shown in FIG. 3. The projection 22 preferably consists of a separate part of hardened steel pressed into a corresponding bore in the slide bar 2*a*. The two grooves 23 are effective as recesses for a clamp opener (not shown); they are of no importance for the present invention and therefore need not be described herein in greater detail. The slide bars 2a can be produced, for example, by cutting from a sheet or panel of plastics. The same is made preferably of carbon fiber reinforced PEEK (polyether-etherketone), but a polyamide can be considered instead of PEEK. FIG. 2 shows a slide bar 2a of rectangular cross-section, but the cross-section could be trapezoidal as in the case of the known steel retractors. If an easy-slide plastics is used no lubrication is needed.

The combination according to the invention shown in FIG. 3 comprises a dynamic servo motor 3 and a low-weight weft yarn changer 1. The motor 3 and the changer body 11 are interconnected by way of a toothed belt drive 31 (gear 32) and a shaft 16. By means of a locking segment 17 formed with grooves 18 for a lever of a stop device (not shown) movement of the changer out of the predetermined positions can be prevented (to further reduce the weight of the changer the stop or locking action can be produced magnetically or electromagnetically). With an accurately operating servo motor 4, the stop device need only perform one other detector function: in the event of the changer position deviating from the set position a correction signal is generated, which is transmitted to the servo motor.

The drive 4 for reciprocating the yarn transfer element 2 comprises a slider 41, an entraining member 42, a connecting link 43, a pivotable lever 45 (or 45') and a guide 49 of the slider 41. A double arrow 46 indicates the pivoting movement of the lever 45 between the rear position and the a front position, the front position being shown in chain-dotted lines. The guide 49 causes the slider 41 to move parallel to the slide bar 2a and at the same height as the latter.

For the sake of clarity various simplifications have been made in FIG. 3. No guide tubes for the weft yarns on the body 11 between the shaft 16 and grooves 12 are shown nor are guide elements 13 (see FIG. 2) shown in the channels 12. Also, only one of four yarn transfer elements is shown.

The lateral projection 22 on the slide bar 2a serves to couple the same with the slider 41 by way of the entraining member 42 and, in co-operation with the arcuate groove 29 in which the projection 22 is guided when the changer 1 pivots, prevents a displacement of the inoperative yarn transfer elements 2 in the picking direction. A second part of the guide groove 29 is disposed in laterally inverted relationship above the horizontal plane determined by the sliding movement of the slide bar 2a (center line) and slider 41.

Using the directly driven multiple weft device in the projectile loom according to the invention is particularly advantageous in view of the ever-increasing automation of weaving. For example, optimal operating parameters which depend, for example, upon the kind of yarn, the weft repeat and cloth width, can be adjusted simply and rapidly by programming. Programming also simplifies program resetting of the multiple weft device, for example, for the automatic clearance of mispicks. Since the space required for direct drive is considerably less than when mechanical control units are used, the further advantage is provided of improved access for adjustments and servicing. Also, the freely programmable direct drive facilitates standardization of the number of different weft yarns. In the known projectile looms weft mixers or two-color units or four-color units of different kinds are used in dependence upon the number of weft yarns. This large number of control units is unnecessary with direct drive, with obvious cost advantages.

We claim:

1. A projectile loom having a multiple weft device driven directly by a dynamic servo motor, a weft yarn changer of such device having a low-weight body and low-weight yarn transfer elements, the density of the body being much less than a density of steel, a slide bar of the yarn transfer element being made of a mixture of plastic and reinforcing fibers.

2. A projectile loom according to claim 1, wherein the reinforcing fibers of the slide bars are made of carbon.

3. A projectile loom according to claim 1 wherein the plastic is polyetheretherketone.

4. A projectile loom according to claim 1, wherein the changer body has channels receiving abrasion-resistant guide elements for guiding the yarn transfer elements.

5. A projectile loom according to claim 4, wherein the guide elements are made of steel plate and a remainder of the changer body is made of aluminum.

6. A projectile loom comprising:

a dynamic servo motor; and a weft yarn changer comprising;

a body having a density less than a density of steel and being drivingly coupled to the dynamic servo motor; and yarn transfer elements having a slide bar made of a plastic and reinforcing fibers, the slide bar being slidably mounted to the body.

* * * * *